US006297715B1

(12) United States Patent
Fiedziuszko et al.

(10) Patent No.: US 6,297,715 B1
(45) **Date of Patent: *Oct. 2, 2001**

(54) GENERAL RESPONSE DUAL-MODE, DIELECTRIC RESONATOR LOADED CAVITY FILTER

(75) Inventors: Slawomir J. Fiedziuszko; George A. Fiedziuszko, both of Palo Alto, CA (US)

(73) Assignee: Space Systems/Loral, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/277,810

(22) Filed: Mar. 27, 1999

(51) Int. Cl.[7] ..... H01P 1/20; H01P 7/06
(52) U.S. Cl. ..... 333/209; 333/202; 333/231
(58) Field of Search ..... 333/202, 209, 333/206, 208, 231

(56) References Cited

U.S. PATENT DOCUMENTS

| | | | |
|---|---|---|---|
| 1,133,801 | 3/1915 | Hough | 52/320 |
| 2,406,402 | 8/1946 | Ring | 333/232 |
| 3,205,460 | 9/1965 | Seeley et al. | 333/209 |
| 3,475,642 | 10/1969 | Karp et al. | 315/3.5 |
| 3,496,498 | 2/1970 | Kawahashi et al. | 333/210 |

(List continued on next page.)

OTHER PUBLICATIONS

Kobayashi et al. "Resonant Modes of a Dielectric Rod Resonator Short–Circuited at Both Ends by Parallel Conducting Plates". 8099 IEEE Transactions on Microwave Theory and Techniques, vol. MTT–28, No. 10, Oct. 1980.

Plourde et al. "Microwave Dielectric Resonator Filters Utilizing Ba(2) Ti(9) O(20) Ceramics", 1977, IEEE MTT–S International Microwave Symposium Digest.

(List continued on next page.)

*Primary Examiner*—Robert Pascal
*Assistant Examiner*—Kimberly E Glenn
(74) *Attorney, Agent, or Firm*—Kenneth W. Float

(57) ABSTRACT

A ceramic resonator element having high Q, high dielectric constant, and a low temperature coefficient of resonant frequency is enclosed within a cavity to form a composite microwave resonator having reduced dimensions and weight as compared to a simple cavity resonator. In an exemplary embodiment, a pair of tuning screws extend into the cavity along orthogonal axes to tune the structure to resonance along these axes at frequencies near the fundamental resonance of the ceramic element. Several such cavities can be formed in a short length of waveguide by the use of transverse partitions at spaced intervals and coupling between cavities can be accomplished by using simple slot, cross or circular irises. In each cavity, a mode-perturbing screw is positioned along an axis 45° from each of the orthogonal tuning screws, such that resonance along either of the orthogonal axes is coupled to excite resonance also along the other. The input and output coupling devices are disposed at locations that are angularly separated from the corresponding tuning devices by a selectable angle that varies between 0 degrees and ±180 degrees. This Variability in location of the input and output coupling devices provides for a filter having adjustable input/output coupling. The realization of complex filter functions requiring cross couplings is feasible by means of coupling separately to only one of the two orthogonal resonant-modes in the cavities.

18 Claims, 3 Drawing Sheets

U.S. PATENT DOCUMENTS

| | | | |
|---|---|---|---|
| 3,516,030 | 6/1970 | Brumbelow | 333/212 |
| 3,680,012 | 7/1972 | Moreau | 333/212 |
| 3,697,898 | 10/1972 | Blachier et al. | 333/209 |
| 3,969,692 | 7/1976 | Williams et al. | 333/212 |
| 4,019,161 | 4/1977 | Kimura et al. | 333/234 |
| 4,027,256 | 5/1977 | Dixon | 333/17 L |
| 4,028,652 | 6/1977 | Wakino et al. | 333/209 |
| 4,060,779 | 11/1977 | Atia et al. | 333/212 |
| 4,135,133 | 1/1979 | Mok | 333/73 W |
| 4,142,164 | 2/1979 | Nishikawa et al. | 333/227 |
| 4,143,344 | 3/1979 | Nishikawa et al. | 333/202 |
| 4,184,130 | 1/1980 | Nishikawa et al. | 333/202 X |
| 4,197,514 | 4/1980 | Kasuga et al. | 333/28 R |
| 4,216,448 | 8/1980 | Kasuga et al. | 333/203 |
| 4,267,537 | 5/1981 | Karmel | 333/231 |
| 4,453,146 | 6/1984 | Fiedziuszko | 333/212 |
| 4,489,293 * | 12/1984 | Fiedziuszko | 333/202 |

OTHER PUBLICATIONS

Guillon et al. "Dielectric Resonator Dual Modes Filter", 8030 Electronics Letters, vol. 16, (Aug., 1980), No. 17.

Pfitzenmaier "A Waveguide Multiplexer with Dual–Mode Filters for Satellite Use", 5th European Microwave Conference, Sep. 1–4, 1975, Hamburg, Germany.

Mahieu "Low Conversion Losses Up and Down Converters, Using Dielectric Resonators for Application with Millimetric Telecommunication Systems", 6th European Microwave Conference, Sep. 14–17, 1976, Rome, Italy.

* cited by examiner

GENERAL RESPONSE DUAL-MODE, DIELECTRIC RESONATOR LOADED CAVITY FILTER

BACKGROUND

The present invention relates generally to microwave filters, and more particularly, to general response dual-mode, dielectric resonator loaded cavity microwave filters and multiplexers for use in transmitters and receivers for satellite and wireless system applications.

1. Field of the Invention

The present invention relates to microwave filters for use in transmitters and receivers designed to meet difficult requirements of small size, low weight, and tolerance to extreme environmental conditions. Filters according to the teachings of the present invention are thus suited to use in mobile, airborne, or satellite and wireless communication systems in which the requirement exists to sharply define a number of relatively narrow frequency bands or channels within a relatively broader portion of the frequency spectrum. Thus, filters designed according to the present invention are especially useful in bandpass configurations which define the many adjacent channels utilized in satellite communication stations for both military and civilian purposes.

Such satellite communication stations have come to be used for a variety of purposes such as meteorological data, gathering, ground surveillance, various-kinds of telecommunication, and the retransmission of commercial television entertainment programs. Since the cost of placing a satellite in orbit is considerable, each satellite must serve as many communication purposes and cover as many frequency channels as possible. Consequently, the ability to realize complex and sophisticated filter functions in compact and lightweight filter units is a significant advance which permits the extension of frequency band coverage without an increase in size or weight. Moreover, these advances are possible without relaxing the stringent requirements which must be met by such communication systems, including the requirement to maintain stable performance over a wide range of temperature.

2. Description of the Prior Art

U.S. Pat. No. 3,205,460 issued to E. W. Seeley et al. discloses a microwave filter formed of rectangular waveguide dimensioned to be below cutoff at the frequencies for which the filter is designed. However. a rectangular slab of dielectric extends from top to bottom of the waveguide at spaced intervals along the midplane line of the waveguide, such that a series of spaced susceptances is produced. Tuning screws were used to permit fine tuning of the filter. However, this patent contains no information concerning how to realize filter functions more complex than a simple iterative bandpass design. In particular, there are no teachings as to how to employ dual mode operation, or as to ways to realize cross-couplings for filter designs that require them.

U.S. Pat. No. 3,475,642 issued to A. Karp et al. discloses a slow-wave structure in which a series of spaced discs of rutile ceramic t .tend along a waveguide. The patent contains no teachings of the advantages of using dual mode operation, and employs single mode operation in the $TE_{01}^{\delta}$ mode.

U.S. Pat. No. 3,496,498 issued to T. Kawahashi et al. discloses a microwave filter in which a series of metal rods, each dimensioned to be a quarter wavelength long at the frequencies of interest, are spaced along a waveguide structure to form the filter. The rods may be grooved to vary their electrical length without changing their physical length.

U.S. Pat. No. 4,019,161 issued to Kimura et al. discloses a temperature-compensated dielectric resonator device utilizing single-mode operation in the $TE_{01}^{\delta}$ mode.

U.S. Pat. No. 4,027,256 issued to Dixon discloses a wideband ferrite limiter in which a ferrite rod extends axially along the center of a cylindrical dielectric structure and through the centers of a plurality of dielectric resonator discs that are spaced along the resonant structure. The patent contains little of interest relating to realization of microwave filter functions in compact high performance filter units.

U.S. Pat. No. 4,028,652 issued to Wakino et al. discloses a single-mode filter design in which a variety of differently shaped and dimensioned ceramic resolution elements are disclosed and described. The patent does not, however, suggest the use of dual-mode operation of any of the resonant structures.

U.S. Pat. No. 4,142,164 issued to Nishikawa et al. discloses a dielectric resonator utilizing the $TE_{01}^{\delta}$ mode. The patent primarily discloses the technique of fine tuning by the application of selected amounts of a synthetic resin which bonds to the ceramic resonator elements to incrementally alter their resonant frequencies. There is no suggestion to use dual-mode operation.

U.S. Pat. No. 4,143,344 issued to Nishikawa et al. discloses a microwave resonant structure that utilizes two modes in its operation. However, the modes utilized, using the nomenclature of this reference, are the $H_{01}^{\delta}$ and $E_{01}^{\delta}$ modes which have very dissimilar field distributions. At least partly as a consequence of this fact, the reference contains no teachings as to how to control coupling to each of the modes, and therefore does not show how to realize one pole of a filter function with each of the modes. As a result, there would be no way within the teachings of this patent to realize a complex 6-pole response in a filter having only three resonators, as could be done if coupling to each of the modes could be independently controlled.

U.S. Pat. No. 4,184,130 issued to Nishikawa et al., and covers a filter design employing a single mode ($TE_{01}^{\delta}$) in a resonator which is coupled to a coaxial line by means of a short section of that line which has been made leaky by cutting apertures in the outer conductor.

U.S. Pat. No. 4,197,514 issued to Kasuga et al. discloses a microwave delay equalizer. There is no suggestion as to how to make miniature high performance filters that implement complex filter functions.

In addition to the above prior art which disclose solid, high dielectric constant resonant elements, there is prior art in which unfilled cavity resonators of a variety of configurations are employed, sometimes with dual-mode operation. However, due to the unity dielectric constant of the resonant space, the resultant structures are relatively bulky. The prior art relating to unfilled cavity resonators includes U.S. Pat. No. 3,697898 to Blachier et al., U.S. Pat. No. 3,969,692 to Williams et al., U.S. Pat. No. 4,060,779 to Atia et al., and British Patent No. 1,133,801 to Craven.

The Williams et al. patent discusses dual mode filters utilizing conventional cavity resonators, while the British patent utilizes evanescent modes. However, none of this prior art relating to unfilled cavity resonators contains any suggestion to significantly reduce the volume of the resonant structure by employing resonator element of high dielectric constant as the principal component of the resonator, while enclosing this element within a reduced-dimension cavity which would itself be below cutoff at the frequencies of interest were it not for the included resonator element.

An article by Kobayashi et al. entitled "Resonant Modes of a Dielectric Rod Resonator Short-Circuited at Both Ends by Parallel Conducting Plates", 8099 IEEE Transactions on Microwave Theory and Techniques, vol. MTT-28, No. 10, October 1980, New York details experimental studies of resonant modes in a dielectric rod short-circuited at both ends by conductive plates. The Kobayashi reference does not disclose or suggest structures needed to form a functioning microwave filter. For example, no means are provided for tuning the resonator along each of a pair of orthogonal axes, no input and output means are provided.

An article by Plourde et al. entitled "Microwave Dielectric Resonator Filters Utilizing Ba(2) Ti(9) O(20) Ceramics", 1977, IEEE MTT-S International Microwave Symposium Digest discloses a stripline resonant structure different from the coupled-cavity structure employed by Applicant.

An article by Guillon et al. entitled "Dielectric Resonator Dual Modes Filter", 8030 Electronics Letters, vol. 16, (1980), August, No. 17, discloses a single-cavity filter which is more nearly a laboratory model for investigation of microwave phenomena than a completed filter design. Consequently, the reference fails to disclose the intercavity-coupling structure and other details which would be necessary to realize a successful multi-cavity design such as would be required for a practical six, eight or more pole filter function.

An article by Pfitzenmaier entitled "A Waveguide Multiplexer with Dual-Mode Filters for Satellite Use", 5th European Microwave Conference, Sep. 1–4, 1975, Hamburg, Germany is representative of prior art discussed above relating to unfilled cavity resonators. In common with the patent references mentioned relating to unfilled cavity resonators, the Pfitzenmaier reference lacks any suggestion as to how to reduce the bulk and weight of prior art unfilled cavity resonators.

An article by Mahieu entitled "Low Conversion Losses Up and Down Converters, Using Dielectric Resonators for Application with Millimetric Telecommunication Systems", 6th European Microwave Conference, Sep. 14–17, 1976, Rome, Italy discloses frequency converters and mixers employing dielectric resonators, but does not teach the employment of such elements in filter realizations.

With regard to the most relevant prior art, U.S. Pat. No. 4,489,293 issued to Fiedziuszko et al. and assigned to the assignee of the present invention, discloses filter functions in the form of compact filter units that use composite resonators operating simultaneously in each of two orthogonal resonant modes. Each of the orthogonal resonant modes is tunable independently of the other, such that each can be used to realize a separate pole of a filter function.

The composite resonators comprise resonator elements made of a high dielectric constant solid material and may comprise short cylindrical sections of a ceramic material, together with a surrounding cavity resonator that is dimensioned small enough in comparison to the wavelengths involved that it would be well below cutoff but for the high dielectric constant resonator element within the cavity.

Capacitive probes or inductive irises may be used to provide coupling between several such composite resonators, and also to provide input and output coupling for the filter unit formed of the composite resonators. By suitably positioning the coupling devices with respect to the two orthogonal resonant modes, it is possible to achieve cross-coupling between any desired resonant modes, such that filter functions requiring such couplings can easily be realized.

Independent tuning of the orthogonal resonant modes is achieved by the use of a pair of tuning screws projecting inwardly from the cavity wall along axes that are orthogonal to one another. Microwave resonance along either of these axes is coupled to excite resonance along the other by a mode coupling screw projecting into the cavity along an axis which is at 45° to the orthogonal mode axes.

While the filter disclosed in U.S. Pat. No. 4,197,514 was a significant improvements in the filter art, the present inventors have developed a more generalized filter than is disclosed in this patent that provides for variable input/output coupling and which is readily adaptable to many filter applications.

Thus, it would be advantageous to have a microwave filter which can readily realize complex filter functions involving several or many poles, or cross-couplings between poles, and which has variable input/output coupling. It would also be advantageous to have a plurality of composite resonators, together with microwave coupling arrangement therebetweeti to form a filter capable of realizing a variety of complex filter functions within a compact and lightweight unit, and which have variable input/output coupling.

It would be advantageous to have a composite resonator that causes simultaneous resonance in each of two orthogonal resonant modes, and that may be separately tuned for each of the orthogonal modes. It would also be advantageous to have the ability to perturb the fields in the resonator to control coupling between the two orthogonal resonant modes.

SUMMARY OF THE INVENTION

The present invention realizes filter functions in the form of compact filter units that utilize composite resonators operating simultaneously in each of two orthogonal resonat modes. Each of the orthogonal resonalt modes is tunable independently of the other, such that each can be used to realize a separate pole of a filter function.

More particularly, the present invention provides for a microwave filter comprising a composite microwave resonator including a cavity resonator and a dielectric resonator element disposed within the cavity resonator. First and second tuning apparatus are disposed along first and second axes for tuning the composite resonator to resonance in first and second orthogonal resonant modes, respectively. Modes coupling apparatus is employed to adjust the amount of energy coupled between the two orthogonal resonant modes. Input coupling apparatus is provided to couple microwave energy into the cavity resonator. Output coupling apparatus is provieded that couples a portion of the resonant energy out of the cavity resonator. The input and output coupling apparatus may be disposed at locations that are angularly separated from the corresponding tuning devices by a selectable angle that varies between 0 and ±180 degrees. This variability in location of the input and output coupling devices provides for a filter having adjustable input/output coupling. The prosent invention enables realization of steeper response filters and also enables realization of asymmetric response filters in a dual mode filter configuration.

the composite resonators comprise resonator elements made of a high dielectric constant solid material and may comprise short cylindrical sections of a ceramic material, together with a surrounding cavity resonator that is dimensioned small enough in comparison to the wavelengths involved that it would be well below cutoff but for the high dielectric constant resonator element within the cavity.

Capacitive probes or inductive irises may be used to provide coupling between several composite reonators, and also to provide input and output coupling fo the filter unit formed of the composite resonators. By suitable positioning the coupling divices with respect to the two orthogonal resonant modes, it is possible to achieve cross-coupling between any desired resonant modes, such that filter functions requiring such coupling can easily be realized.

Independent tuning of the orthogonal resonant modes is achieved by the use of a pair of tuning screwa projecting inwardly from the cavity wall along axes that are orthogonal to one another. Microwave resonance along either of these axes is coupled to excite resonance along the other by a mode coupling screw projecting into the cavity along an axis which is at 45° to the orthogonal mode axes.

Alternatively, the surface of the dielectric resonator element or the interior surface of the wall of the waveguide may be perturbed by creating bumps or dimples in the respective surfaces to cause tuning or mutual coupling between the orthogonal resonant modes.

Excellent temperature stability is achieved by choosing a resonator material having a temperature coefficient of resonant frequency which is nearly zero, and by selecting materials for the resonant cavity and the tuning screws such that thermal expansion of one is very nearly compensated by thermal expansion of the other.

The present invention may be advantageously employed in microwave, high performnance filters and multiplexers for satellite and wireless system applications.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
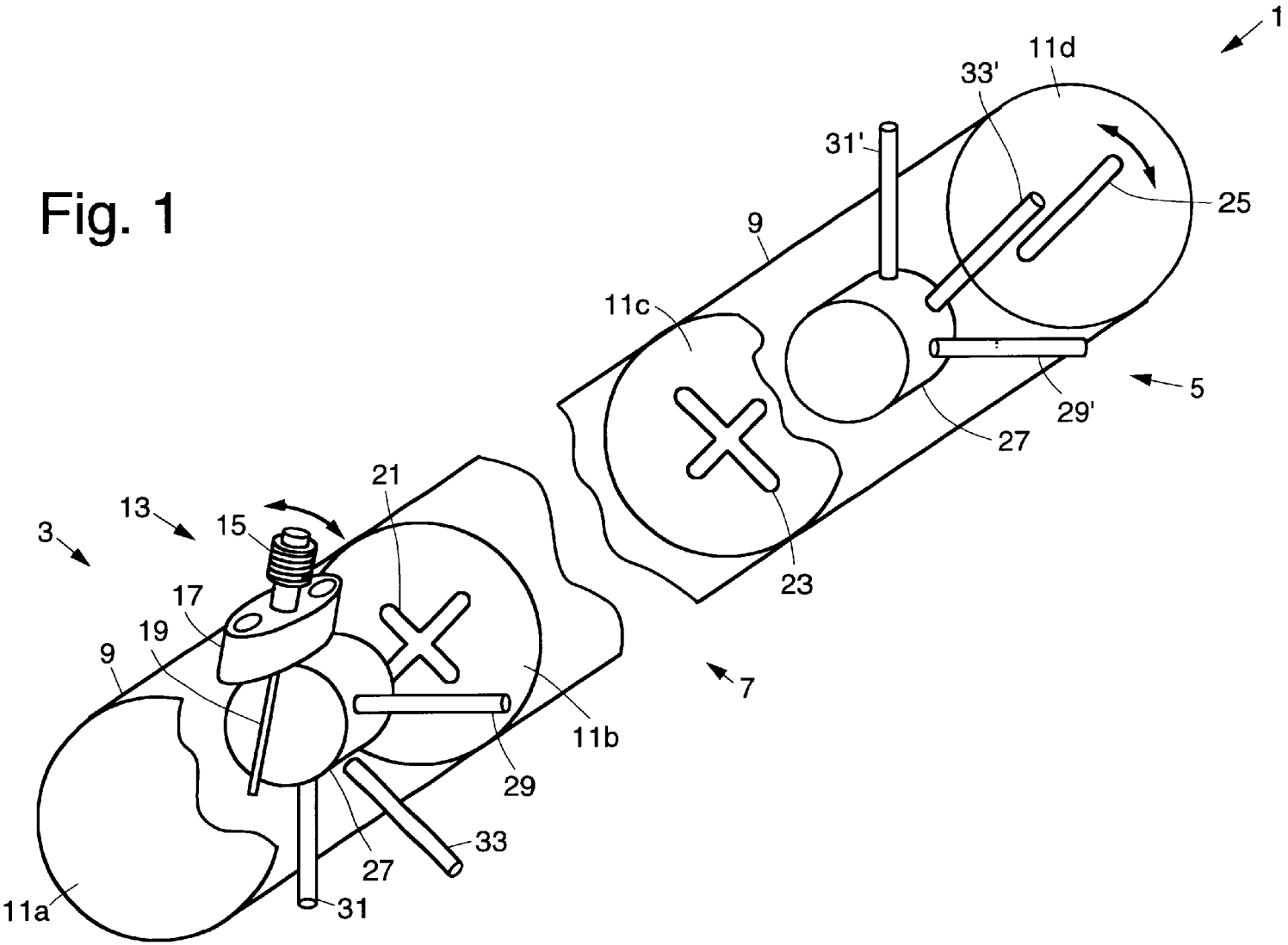
FIG. 1 is a partially exposed perspective view illustrating an exemplary ellipticfunction multiple-cavity filter embodying features of the present invention.

Referring to the drawing figures, FIG. 1 shows a multi-cavity filter 1 embodying features of the present invention. The multi-cavity filter 1 comprises an input cavity 3, an output cavity 5, and one or more intermediate cavities 7, which are indicated more-or-less schematically in the broken region between the input and output cavities 3, 5. The cavities 3, 5, 7 may all be electrically defined within a short length of cylindrical waveguide 9 by a series of spaced, transversely extending cavity endwalls 11*a–d*. The endwalls 11*a–d* and waveguide 9 may be made of Invar or graphite-fiber-reinforced plastic (GFRP) or of any other known material from which waveguide hardware is commonly made. The waveguide 9 and the endwalls 11 *a–d* may be surface plated with a highly conductive material such as silver, which may be applied by being sputtered onto the surfaces thereof. The endwalls 11 *a–d* may be joined to the interior wall of the waveguide 9 by any known brazing or soldering technique, or by other known bonding techniques as appropriate to the materials concerned.

An input coupling device in the form of a probe assembly 13 or connector 13 is used to couple microwave energy from an external source (not shown) into the input cavity 3. The probe assembly 13 includes a coaxial input connector 15, an insulative mounting block 17, and a capacitive probe 19. Microwave energy coupled to the probe 19 is radiated therefrom into the input cavity 3, where microwave resonance is excited in a hybrid $HE_{111}$ mode. From the input cavity 3, microwave energy is coupled into the intermediate cavities 7 by a first coupling iris 21 having a cruciform shape, and from the intermediate cavities 7 into the output cavity 5 by a second coupling iris 23, also having a cruciform shape. Finally, energy is coupled from the output cavity-5 into a waveguide system (not shown) by an output iris 25 having a slot configuration.

Within each of the cavities 3, 5, 7 is disposed a dielectric resonator element 27 made of a material possessing a high dielectric constant, a high Q, and a low temperature coefficient of resonant frequency. The resonator element 27 is cylindrical in form as shown, such that together with the cylindrical cavities 3, 5, 7, composite resonators of axially symmetric shape are formed. The resonator elements 27 may be made of a variety of materials such as rutile, barium tetratitanate ($BaTi_4O_9$), related ceramic compounds such as the $Ba_2Ti_9O_{20}$ compound which was developed by Bell Laboratories, or a series of barium zirconate ceramic compounds which are available from Murata Mfg. Co. under the trade name Resomics.

The best of such materials form ceramic resonator elements possessing the desirable combination of high dielectric constant (>35), high Q (>7500), and a low temperature coefficient of resonant frequency K15 for barium tetratitanate and as low as 0.5 for Resomics, in ppn/° C.). With careful design and choice of materials for the cavities 3, 5, 7, the composite resonators formed by the combination of the cavity and the resonator element can also possess a high Q and a low temperature coefficient of resonant frequency, while the high dielectric constant of the resonator element concentrates the electromagnetic field of resonant energy within the dielectric element, thus significantly reducing the physical size of the composite resonator as compared to "empty" cavity resonators designed for the same resonant frequency.

Although, as noted above, each cylindrical resonator element 27 together with the cylindrical cavity 3, 5, 7 in which it is disposed, forms a composite resonator having axial symmetry, each of these composite resonators is provided with means to tune it to resonance along each of a pair of orthogonal axes. Thus, in FIG. 1, a first tuning screw 29 projects into the input cavity 3 along a first, axis which intersects the axis of the cavity 3 and the resonator element 27 at substantially a 90° angle thereto. A second tuning screw 31 similarly projects into the cavity 3 along a second axis which is rotationally displaced from the first axis by 90°. The tuning screws 29, 31 serve to tune the cavity 3 to resonance in each of two orthogonal $HE_{111}$ resonant modes respectively. Since the amount of projection of the tuning screws 29, 31 is independently adjustable, each of the two orthogonal modes can be separately tuned to a precisely selected resonant frequency, such that the input cavity 3 can provide a realization of two of the poles of a complex filter functions In order to provide a variable amount of coupling between the two orthogonal resonant modes in the cavity 3, a third tuning screw 33 comprising a mode coupling screw 33 is provided that extends into the cavity 3 along a third axis that is substantially midway between the first two axes at an angle of 45° thereto. The third tuning screw 33 serves to perturb the electromagnetic field of resonant energy within the cavity such that energy is controllably coupled between the two orthogonal resonant modes. Moreover, the degree of such coupling is variable by varying the amount by which the third tuning screw 33 projects into the cavity 3.

Alternatively, the surface of the dielectric resonator element 27 or the interior surface of the wall of the waveguide 9 may be perturbed by creating bumps or dimples in the respective surfaces to cause tuning or mutual coupling between the orthogonal resonant modes.

As noted above, the waveguide 9 may be formed of a variety of known materials. One particularly satisfactory material is thin (0.3 to 1.0 mm) Invar, which can be used to form the cavity resonators and the endwalls 11*a–d*. The low temperature coefficient of expansion (~1.6 ppm/° C.) and fine machinability of this material contribute to the stability and performance of the finished filter. When Invar is used for the waveguide and the endwalls, brazing may be carried out using a "NiOro" brazing alloy consisting of 18% nickel and 82% gold. Similarly. the material used to form the three tuning screws 29, 31, 33 can be selected in consideration of the temperature coefficient of resonant frequency of the resonator element 27 and the temperature coefficient of expansion of the material used for construction of the cavities so that the temperature coefficient of resonant frequency of the composite resonator is as near zero as possible. When Invar is used for the cavity structure, in combination with a resonator element having a coefficient of 0.5 ppm/° C., brass or Invar can be successfully used as materials for the tuning and mode coupling screws. With different choices of material for the cavities, or a different temperature coefficient of resonant frequency of the resonator element 27, other materials such as aluminum may be found useful in securing a near-zero temperature coefficient for the composite resonator.

Although not shown in FIG. 1, the resonator elements 27 can be successfully mounted in the cavities 3, 5, 7 by a variety of insulative mounting elements that generally take the form of pads or short columns of low-loss insulator material such as PTFE. However, the best performance has been obtained by the use of mountings made of a low-loss polystyrene.

Each of the cavities 3, 5, 7 includes the first and second tuning screws 29, 31 extending along orthogonal axes and a mode coupling screw 33 extending along a third axis that is at substantially a 45° angle to the first and second axes. These screws 29, 31, 33 have not been shown for the intermediate cavity 7, but arc illustrated as screws 29', 31', 33' of the output cavity 5, where the primed numbers correspond to like-numbered parts in the cavity 3. Further, although the screws 29', 31', 33' have been illustrated in an alternative orientation with respect to the central axis of the cavities, it is to be understood that their function is not altered thereby, and the orthogonal first and second axes remain in the same position as in the case of the input cavity 3.

Similarly, each cavity 3 shown in the exemplary filter 1 of FIG. 1 includes coupling devices to couple microwave energy into and out of the cavities 3, 5, 7. With the exception of the probe assembly 13 in the input cavity 3, the coupling devices comprise an iris 21, 23, 25 in the embodiment shown in FIG. 1. However, the coupling devices may be capacitive probes, or inductive irises, or any combination of the two. Further, although the irises 21, 23 have been illustrated as cruciform in shape, such that they function as orthogonal slot irises to couple to each of the two orthogonal modes in the respective cavities, other iris forms may be used, depending on the nature of the intercavity coupling required by the filter function being realized.

Figure 2:
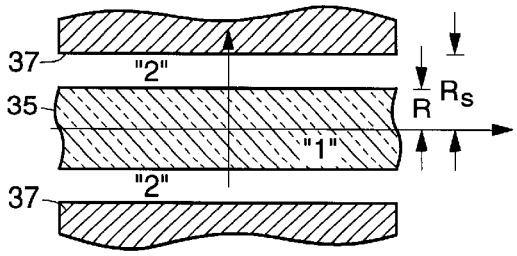
FIG. 2 is a cross-sectional view, partly schematic in form, illustrating a theoretical model useful in calculating resonant frequencies of the filter sections in accordance with the present invention.

FIG. 2 shows a simple theoretical model useful in calculating the resonant frequency of each composite resonator, such that it is possible to accurately design each of the composite resonators needed to realize a complex filter function. In FIG. 2, the composite resonator is modeled as a dielectric cylinder 35 having a radius R that is made of a material having a dielectric constant $\in$, coaxially surrounded by a cylindrical conductive wall 37 representing the inner surface of a circular waveguide of radius $R_S$. In the development which follows, the dielectric-filled region in FIG. 2, marked "1 " in the drawing, is denoted by the subscript 1 following the respective parameters. Similarly, the region marked "2" in the drawing between radius R and radius $R_S$ is assumed to be evacuated and to have a dielectric constant equivalent to free-space permittivity $\in_0$. When referring to this region, the subscript 2 is used.

Using the approach developed by Yaghjian and Komhauser in "A Modal Analysis of the Dielectric Rod Antenna Excited by the $HE_{111}$ Mode", IEEE Trans. on Antennas and Propagation, Vol AP-20, No. 2, March 1972, the longitudinal components of the electromagnetic field in regions "1" and "2" may be expressed in the form:

$E_{zi}=A(K_R I_a - I_R K_a)J_1(hr)\cos\theta e^{-jYi^Z}$, $H_{zi}=B(K_{R'} I_a - I_{R'} K_a)J_1(hr)\sin\theta e^{-jYi^Z}$ in region "1", $E_{Z2}=A[K_R I_1(pr) - I_R K_1(pr)]J_1(hr)\cos\theta e^{-j\gamma i^Z}$, and $H_{Z2}=B[K_{R'} I_1(pr) - I_{R'} K_1(pr)]J_1(hr)\sin\theta e^{-j\gamma i^Z}$ in region "2", where R is the radius of the dielectric cylinder 35, $R_S$ is the radius of the conductive wall 37, $\gamma i$ is the propagation constant in Z-direction, $^{\lambda}0$ is the free-space wavelength corresponding to the resonant frequency $f_0$, $J_1$ is the Bessel function of first kind, first order, and $K_n$ is the modified Hankel function of n-th order in is the modified Bessel function.

All the differentiation is in respect to the argument of the function.

$I_a=I_1(pR)$, $I_k=I_1(pR_s)$, $K_a=K_1(pR)$, and $K_R=K_1(pR_s)$.

By considering that the angular (tangential) components of magnetic and electric field must be continuous at the interface between regions "1" and "2" (i.e., at radius R), and introducing for simplicity the relations.

$A_1=K_R I_a - I_R K_a$, $A_2=K_{R'} I_{a'} - I_{R'} K_{a'}$, $B_1=K_{R'} I_a - I_{R'} K_a$, $B_2=K_R I_{a'} - I_R K_{a'}$, and $I=J_1(hR)$, the following transcendental equation is thus obtained:

$$\left[\frac{\varepsilon}{p}A_1J' + \frac{B_2J}{h}\right]\left[\frac{J'B_1}{p} + \frac{A_2J}{h}\right] - \left[\frac{\gamma_i^2}{\omega^2\mu_0\varepsilon_0R^2}A_1B_1J^2\right]\left[\frac{1}{p^2} + \frac{1}{h^2}\right]^2 = 0 \quad [1]$$

Assuming that the dielectric cylinder 35 is either short circuited by an electric wall or open circuited by a magnetic wall: $\gamma_i L=\pi$, and $\gamma_1=\pi/L$. From this relation and equation [1], the resonant frequencies of the $HE_{111}$ mode can be calculated. In these calculations, L is the actual length of the resonator element, while $\mu_0$ is free space permeability. The p and h paranmeters in equation [1] are defined as follows:

$$h^2=\in(2\pi/\lambda_0)^2-\gamma_1^2 \text{ and } p^2=\gamma_1^2-(2\pi/\lambda_0)^2.$$

Calculations of resonant frequency based on equation [1] have proven to be sufficiently accurate to be useful. Their agreement with measured resonant frequencies is reasonably good so long as the ratio of diameter to length of the resonator element is less than about 3. However, it was felt that a closer agreement between predicted and measured results was desirable.

Figure 3:
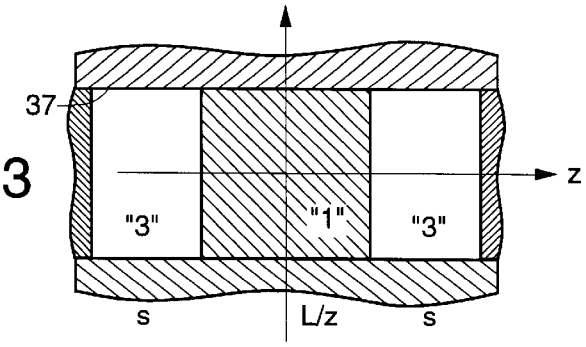
FIG. 3 is a cross-sectional view, partly schematic in form, illustrating a theoretical model useful in calculating axial electromagnetic field distribution in the filter cavities of the present invention.

In FIG. 3, a second theoretical model useful in analyzing the axial distribution of electromagnetic field for the purpose of refining the calculations of resonant frequency is illustrated. A detailed analysis of the resonances of such a structure has been published by Amman and Morris in a paper entitled "Tunable Dielectric-Loaded Microwave Cavities Capable of High Q and High Filling Factor", IEEE Trans. MTT-11, pp. 528–542, November 1963.

Briefly stated, it is possible to analyze the $HE_{111}$ resonance of this structure by separation of this hybrid mode into its linear TE and TM mode-components. In FIG. 3, the region occupied by resonator element 27' has been labeled region "1" as before, while the region beyond the ends of dielectric has been labeled region "3". Using Maxwell's equations to analyze the field within these regions, and matching tangential components of the field at $z=\pm L/2$, it is possible to derive the transcendental equation:

$$\gamma_1 \tan \gamma_1 L/2-\gamma_0 \text{cotan } \gamma_0 s = 0. \quad [2]$$

Equation [2] applies for the TE EVEN mode, for which $E_z=0$, and $H_z$ is symmetrical about the plane z=0. The parameters in equation [2] are defined as follows: $\gamma_1^2=(2\pi/\lambda_0)^2\in-(2\pi/\lambda_c)^2$, $\gamma_0^2=(2\pi/\lambda_c)^2-(2\pi/\lambda_0)^2$, $\lambda_c$ is the cut particular waveguide mode, as determined by geometry and mode order, and s is the distance from transverse metal wall 37.

It can be shown that equations [1] and [2] form a set of coupled equations from which the values of $f_0$ and $\gamma_1$ may be determined, thus providing values of the resonant frequencies. To verify the validity of the resonator model, data was measured for several samples of high-∈, low-loss resonators. This data, showing especially a high degree of correlation between theoretically predicted and measured resonant frequency, is presented below:

| Resonator material | Dielectric constant ∈ | Resonator radius, inch | Resonator length inch | Freq. theor. MHz | Freq. meas. MHz |
|---|---|---|---|---|---|
| Resomics C | 37.6 | .394 | .315 | 3576 | 3368 |
| Resomics C | 37.6 | .316 | .273 | 4181 | 4196 |
| Resomics E | 38.2 | .267 | .222 | 4789 | 4994 |
| Resomics C | 37.6 | .200 | .180 | 6116 | 6255 |

-continued

| Resonator material | Dielectric constant ∈ | Resonator radius, inch | Resonator length inch | Freq. theor. MHz | Freq. meas. MHz |
|---|---|---|---|---|---|
| Resomics C | 37.6 | .212 | .182 | 5844 | 6182 |
| Barium tetratitanate | 37.25 | .336 | .215 | 4115 | 4225 |

The correlation between theoretically predicted and experimentally measured resonant frequencies for these samples, all of which had values of ∈ near 38, and for frequencies in the range of 3–6 GHz, is thus within 5%.

Figure 4:
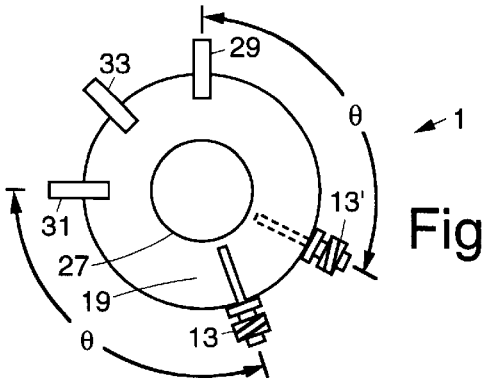
FIG. 4 is a front end view of an exemplary filter having electrical probes as input and output coupling devices.

FIG. 4 illustrates a front end view of an exemplary filter 1 having electrical probes 13, 13' as both the input and output coupling devices. In the filter 1 shown in FIG. 4, the front endwall 11*a* is not shown so that interior components of the first cavity 3 may be shown. The tuning and mode coupling screws of the output cavity 7 are not shown. The relative angle θ between the input and output electrical probes 13, 13' is shown to be different from the angular separation of the embodiment shown in FIG. 1. The input and output coupling devices (probes 13, 13') may be disposed at locations that are angularly separated from the corresponding tuning screws 31, 29 by a selectable angle that varies between 0 and ±180 degrees. Thus, the input and output coupling devices (probes 13, 13') may be disposed at any location around the periphery of the wall of the filter 1. This variability in location of the input and output coupling devices provides for a filter 1 having adjustable input/output coupling.

Figure 5:
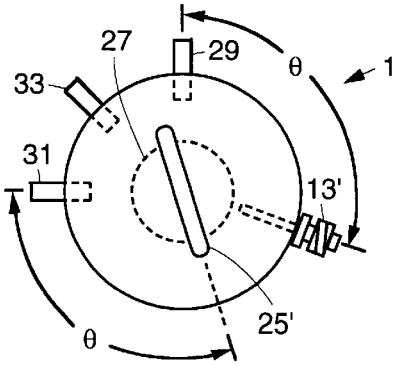
FIG. 5 is a front end view illustrating an exemplary filter having an iris as an input coupling device and an electrical probe as an output coupling device.
Figure 6:
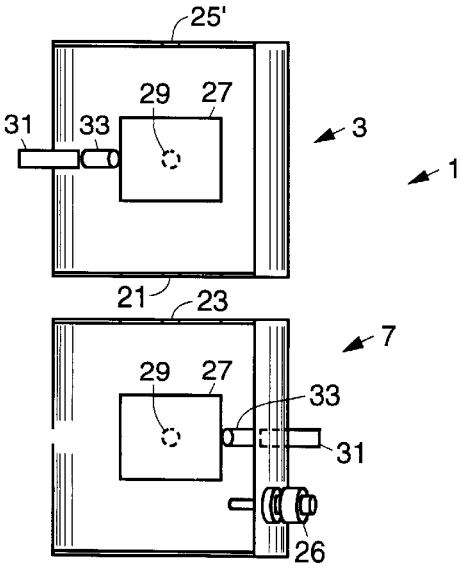
FIG. 6 is a side view of the filter of FIG. 5.

FIG. 5 is a front end view illustrating an exemplary filter 1 having an iris 25' as an input coupling device an electrical probe 13' as an output coupling device. FIG. 6 is a side view of the filter 1 shown in FIG. 5 showing only the input and output cavities 3, 7. The iris 25' is disposed in the front endwall 11*a* of the first cavity 3, and selected other interior components are shown in phantom. The tuning and mode coupling screws of the output cavity 7 are not shown, and only the output electrical probe 13' is shown. The relative angle θ between the input iris 25' and the output electrical probe 13' is shown to be different from the angular separation of the embodiments shown in FIGS. 1 and 4. Again, the variability in location of the input and output coupling devices provides for a filter 1 having adjustable input/output coupling.

Again, as in the embodiment of the filter 1 shown in FIG. 4, the input and output coupling devices (input iris 25', output probe 13') may be disposed at locations that are angularly separated from the corresponding tuning screws 31, 29 by a selectable angle that varies between 0 and ±180 degrees. Thus, the input and output coupling devices (input iris 25', output probe 13') may be disposed at any location around the periphery of the wall of the filter 1.

Figure 7:
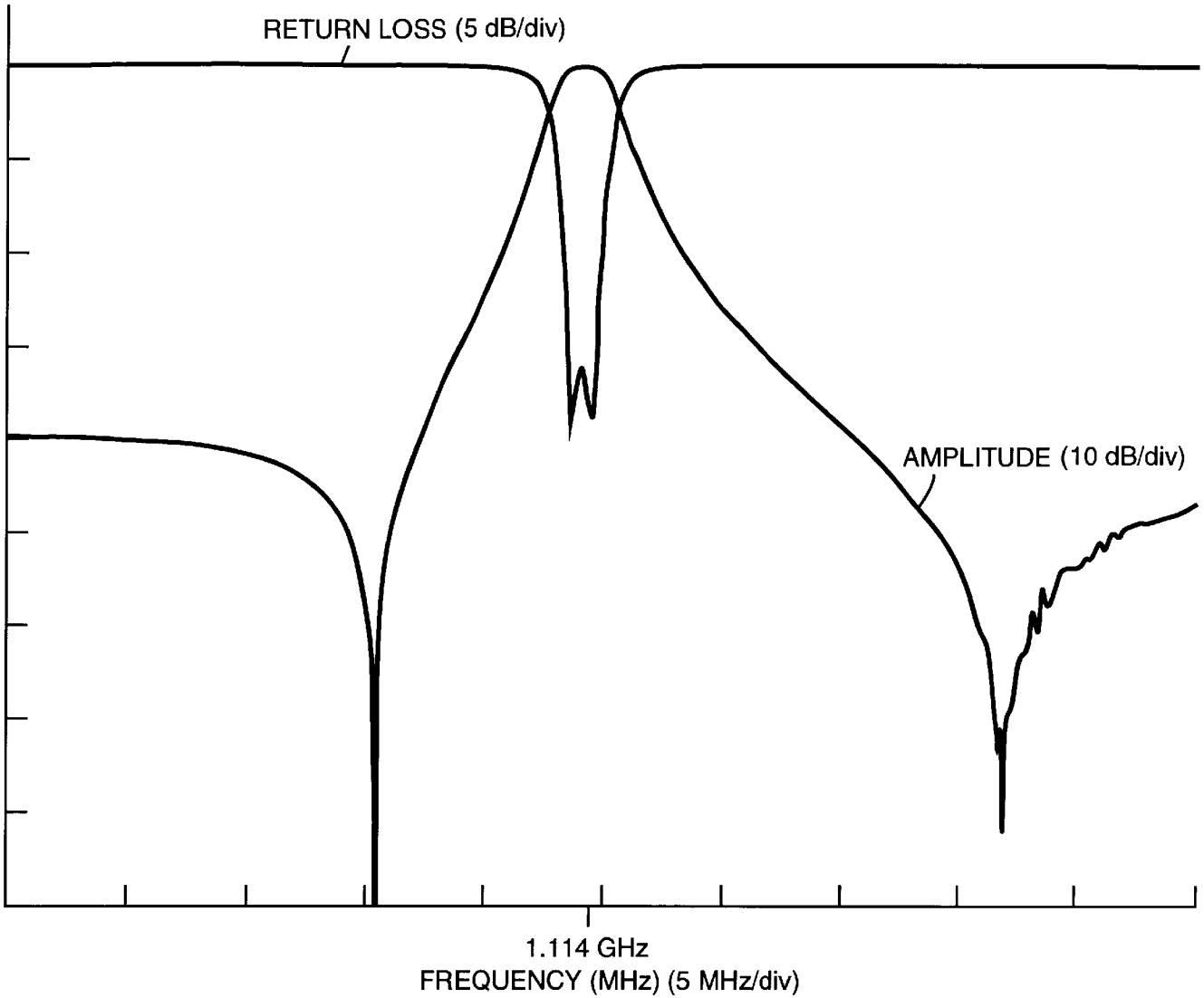
FIG. 7 is a graphical representation of the passband performance of an 8-pole quasi-elliptic filter function in accordance with the teachings of the present invention.

Referring to FIG. 7, the passband performance of an 2-pole, elliptic bandpass filter 1 built in accordance with the teachings of the present invention is illustrated.

FIG. 7 is representative of the performance of a filter 1 constructed in accordance with the embodiment of FIG. 1, using a total of only one cavity. The topmost curve in FIG. 7 represents the return loss through the filter 1. The lower curve corresponds to the amplitude or frequency response of the filter 1.

The frequency response of the filter 1 is shown on a highly magnified frequency scale that is centered on the narrow passband region at approximately 1.114 GHz. The frequency response curve illustrates that two transmission zeros related to proper input/output coupling are present. Reflected power is shown in the form of the return loss curve, which is similar to a curve of VSWR for the filter, except that the amplitude is plotted on a logarithmic) scale. The return loss curve shows that the two pole filter 1 was successfully realized.

The performance revealed by the curves of FIG. 7 is indicative of a very high-Q, low loss design. In the past such performance has been achieved by the use of low-loss unfilled cavity resonators in this frequency range. While the electrical performance of such resonators was thus entirely satisfactory, their physical size and weight prevented their utilization in many-applications, and exacted too heavy a toll in others when they were used. However, the use of composite resonators employing a high-Q, high-c resonator element operating in a cavity resonator of considerably reduced size in accordance with the teachings of the present invention can be expected to permit the realization of high performance filters in units so compact and lightweight as to make their use in the most demanding applications a reality.

Thus, improved resonators and microwave filters have been disclosed. Although the invention of this application has been described with reference to preferred embodiments that comprise the best mode contemplated by the inventor for carrying out the invention, it should be clear to those skilled in the art that many changes could be made and many apparently different embodiments thus derived without departing from the scope of the invention. Thus, it is to be understood that the described embodiment is merely illustrative of some of the many specific embodiments that represent applications of the principles of the present invention.

For example, although the invention has been disclosed in embodimens that use cylindrical resonator elements disposed in cylindrical cavity resonators, the invention is not limited to this geometry. In fact, other axially symmetric configurations such as a square cross-section normal to the composite resonator axis could be used for either the dielectric resonator element or the cavity resonator or for both. Similarly, although fabrication technology and thermal problems at present have been quite successfully solved by the use of thin-wall aluminum cavity structures, it is anticipated that other materials may seem more advantageous in the future as their fabrication technologies and temperature compensation problems are more fully developed and resolved. Accordingly, numerous and other arrangements can be readily devised by those skilled in the art without departing from the scope of the invention.

What is claimed is:

1. A microwave filter comprising:

a composite microwave resonator comprising a cavity resonator and a dielectric resonator element disposed within the cavity resonator that comprises a material having a high dielectric constant and a high Q, the resonator element having a self-resonant frequency, the dimensions of the cavity resonator being selected to cause the composite resonator to have a first order resonance at a frequency near the self-resonant frequency;

first tuning apparatus disposed along a first axis for tuning the composite resonator to resonance in a first resonant mode;

second tuning apparatus disposed along a second axis that is substantially orthogonal to the first axis for tuning the composite resonator to resonance in a second resonant mode;

mode coupling apparatus for adjusting the amount of energy coupled between the first and second resonant modes;

input coupling apparatus for coupling microwave energy into the cavity resonator, and which is disposed at an angle between 0 degrees and ±180 degrees relative to the first axis defined by the first tuning apparatus;

and wherein at least one of the input and output coupling apparatus is disposed at an angle that is different from the first or second axes to provide variable input/output coupling, such that at least one of the input and output coupling apparatus couples to first and second resonant modes.

2. The filter recited in claim 1 wherein the cavity resonator is a cylindrical cavity, and wherein the first and second axes intersect an axis of the cylindrical cavity, and the resonator element is disposed generally on the axis of the cavity.

3. The filter recited in claim 1 wherein the resonances on the first and second axes are resonances in the $HE_{111}$ mode.

4. The filter recited in claim 2 wherein the resonator element is cylindrical and is disposed with its axis generally collinear with the axis of the cavity.

5. The filter recited in claim 1 wherein the resonator element is made of a material selected from the class consisting of rutile, barium tetratitanate ($BaTi_4O_9$), $Ba_2Ti_9O_{20}$ and barium zirconate compounds.

6. The filter recited in claim 1 wherein the resonator element is selected to have a temperature coefficient <1 ppm/° C., and wherein the cavity resonator is made of Invar.

7. The filter recited in claim 1 wherein the first tuning apparatus is adjustable to selectably vary the frequency of resonance.

8. The filter recited in claim 7 wherein the first tuning apparatus comprises an adjustable susceptance extending along the first axis from a wall of the cavity resonator toward the resonator element.

9. The filter recited in claim 8 wherein the adjustable susceptance comprises a tuning screw extending through the wall of the cavity resonator.

10. The filter recited in claim 1 wherein the mode coupling apparatus comprises an adjustable susceptance disposed along a third axis generally equi-angularly spaced from the first and second axes.

11. The filter recited in claim 10 wherein the mode coupling apparatus comprises a mode coupling screw extending through a wall of the cavity resonator toward the resonator element along the third axis, and wherein the third axis is angularly spaced from each of the first and second axes by substantially 45°.

12. The filter recited in claim 6 wherein the first and second tuning apparatus and the mode coupling apparatus comprise independently adjustable susceptances made of a material selected to compensate for temperature variations in the resonant frequency of the composite resonator, and to thereby maintain a temperature coefficient of resonant frequency of the composite resonator of <1 ppm/° C.

13. The filter recited in claim 12 wherein the material is selected from the class consisting of brass, Invar, and aluminum.

14. The filter recited in claim 1 wherein the input and output coupling apparatus respectively selected from a group including an electrical probe and an iris.

15. A microwave filter comprising:

a first resonator having a first cavity and a first dielectric resonator element disposed within the first cavity that comprises a material having a high dielectric constant and a high Q, the first dielectric resonator element having a first self-resonant frequency, the dimensions of the first cavity being selected so that the first resonator has a first order resonance at a frequency near the first self-resonant frequency;

a second resonator having a second cavity and a second dielectric resonator element disposed within the second cavity that comprises a material having a high dielectric constant and a high Q, the second dielectric resonator element having a second self-resonant frequency, the dimensions of the second cavity being selected so that the second resonator has a first order resonance at a frequency near the second self-resonant frequency;

first tuning apparatus in the first resonator disposed along a first axis for tuning the first resonator to resonance in a first resonant mode;

second tuning apparatus in the first resonator disposed along a second axis that is substantially orthogonal to the first axis for tuning the first resonator to resonance in a second resonant mode;

third tuning apparatus in the second resonator disposed along a third axis for tuning the second resonator to resonance in a third resonant mode;

fourth tuning apparatus in the second resonator disposed along a fourth axis that is substantially orthogonal to the third axis for tuning the second resonator to resonance in a fourth resonant mode;

first mode coupling apparatus in the first resonator for adjusting the amount of energy coupled between the first and second resonant modes;

second mode coupling apparatus in the second resonator for adjusting the amount of energy coupled between the third and fourth resonant modes;

input coupling apparatus for coupling microwave energy into the into the first resonator, and which is disposed at an angle between 0 degrees and ±180 degrees relative to the first axis defined by the first tuning apparatus;

the first and second resonators sharing a common wall comprising intercavity coupling apparatus for coupling energy from the first to the second resonator;

and wherein at least one of the input and output coupling apparatus is disposed at an angle that is different from the first or second axes to provide variable input/output coupling, such that at least one of the input and output coupling apparatus couples to first and second resonant modes.

16. The filter recited in claim 15 wherein the input and output coupling apparatus respectively selected from a group including an electrical probe and an iris.

17. The filter recited in claim 15 wherein the first and second resonator elements are each made of a material selected from the class consisting of rutile, barium tetratitanate ($BaTi_4O_9$), $Ba_2Ti_9O_{20}$ and barium zirconate compounds.

18. The filter recited in claim 15 wherein the first and second resonator elements are each made of a material selected from the class consisting of brass, Invar, and aluminum.

* * * * *